US005402937A

United States Patent [19]

Buchholz et al.

[11] Patent Number: 5,402,937

[45] Date of Patent: Apr. 4, 1995

[54] PERFORATED BODY AND VALVE WITH PERFORATED BODY

[75] Inventors: Juergen Buchholz, Lauffen; Martin Maier, Moeglingen; Udo Jauernig, Lichtenstein; Hans-Peter Trah, Reutlingen, all of Germany

[73] Assignee: Robert Bosch GmbH, Stuttgart, Germany

[21] Appl. No.: 760,782

[22] Filed: Sep. 16, 1991

[30] Foreign Application Priority Data

Sep. 21, 1990 [DE] Germany ..... 40 29 911.2
Apr. 13, 1991 [DE] Germany ..... 41 12 150.3

[51] Int. Cl.[6] ..... F02M 67/02

[52] U.S. Cl. ..... 239/431; 239/434; 239/585.5

[58] Field of Search ..... 239/552, 559, 555, 601, 239/431, 585.1, 422, 424.5, 431

[56] References Cited

U.S. PATENT DOCUMENTS

| | | | |
|---|---|---|---|
| 505,931 | 10/1893 | Thurman | 239/431 |
| 1,437,201 | 11/1922 | Schumann | 239/431 |
| 3,272,441 | 9/1966 | Davis et al. | 239/431 X |
| 3,921,916 | 11/1975 | Bassous | 239/601 |
| 4,018,387 | 4/1977 | Erb et al. | 239/405 |
| 4,081,136 | 3/1978 | Addams et al. | 239/555 X |
| 4,545,354 | 10/1985 | Jaggle et al. . | |
| 4,733,823 | 3/1988 | Waggener et al. | 239/601 |
| 4,907,748 | 3/1990 | Gardner et al. . | |
| 5,002,231 | 3/1991 | Reiter et al. | 239/585.1 |

FOREIGN PATENT DOCUMENTS

| | | | |
|---|---|---|---|
| 7724 | 2/1980 | European Pat. Off. | 239/585 |
| 0354659 | 2/1990 | European Pat. Off. . | |
| 3240554 | 5/1984 | Germany . | |

*Primary Examiner*—Andres Kashnikow
*Assistant Examiner*—Kevin Weldon
*Attorney, Agent, or Firm*—Edwin E. Greigg; Ronald E. Greigg

[57] ABSTRACT

A valve for injecting a fuel/gas mixture that includes a perforated body, which comprises an upper thin plate and a lower thin plate, both of which are for instance embodied of monocrystalline silicon. At least one conduit is formed between the upper thin plate and the lower thin plate, by way of which conduit the gas meets the fuel injected through the at least one injection port. It is unnecessary to adjust the metered gas quantity. The perforated body and the valve are particularly suitable for injection systems in mixture-compressing internal combustion engines with externally supplied ignition.

26 Claims, 7 Drawing Sheets

PERFORATED BODY AND VALVE WITH PERFORATED BODY

BACKGROUND OF THE INVENTION

The invention is based on a perforated body and a valve with a perforated body as defined hereinafter. An injection valve for injecting a fuel/gas mixture that has a gas guide sheath made from a metal sheet on its downstream end is already known from German Offenlegungsschrift 32 40 554, now U.S. Pat. No. 4,545,354. The injection port of the injection valve is surrounded, in the immediate vicinity of the gas guide sheath, by an annular gas gap that communicates with an annular gas conduit. Because of production tolerances of the annular gas gap, adapting the annular gas gap, which meters the gas quantity, to the requirements of a particular internal combustion engine means that the gas quantity must be measured at each individual injection valve, and then the gas guide sheath must be bent or displaced, or in other words adjusted, accordingly. This adjustment process, and hence the optimization of the annular gas gap, entails a major effort, making large-scale mass production of the known injection valve very expensive.

An injection valve that uses a perforated body comprising two thin plates is also known from European Patent Application 0 354 659, now U.S. Pat. No. 4,907,748. The injection ports of the upper thin plate and the opening of the lower thin plate are offset from one another. However, these plates serve merely to prepare or meter fuel, not to meter a gas enveloping the fuel.

OBJECT AND SUMMARY OF THE INVENTION

The perforated disk according to the invention has an advantage over the prior art that in a simple manner the perforated disk assures a particularly precise embodiment of the injection ports that serve to deliver a first medium and of the conduits serving to deliver a second medium, and thus assures exact metering of the two media without requiring adjustment. An exact and homogeneous mixture of the two media or minimum-sized droplets of fluid can thus be attained within the smallest possible space.

The valve according to the invention has an advantage of enabling metering of the fuel and metering of the gas that prepares and envelopes the fuel by means of the exact embodiment of the conduits in the smallest possible space, without requiring adjustment of the metered gas quantity in the already mounted injection valve. With this combination of fuel and gas metering in the smallest possible space, very good fuel preparation is attained. A suitable location of the conduits in the perforated body makes it possible to aim the gas purposefully at the fuel stream or streams.

Advantageous further features of and improvements to the perforated body disclosed are possible with the provisions set forth herein.

For particularly accurate metering of the fuel and the gas aimed at the fuel, it is advantageous if the upper thin plate and the lower thin plate are of monocrystalline material, and if openings, grooves and recesses in the upper and lower thin plates are formed, they are formed by anisotropic etching. Thus, not only are the thin plates simple to manufacture, but they also have extraordinarily high production accuracy.

It is advantageous if the upper thin plate and the lower thin plate are joined together by bonding, so that a secure connection between the two is created.

For a simple, economical embodiment of the at least one conduit, it is advantageous if at least one lower through groove is formed in an upper end face of the lower thin plate oriented toward the upper thin plate; together with an opposed lower end face of the upper thin plate, oriented toward the lower thin plate, this forms the at least one conduit.

For the same reason, it is likewise advantageous if at least one upper through groove is formed in a lower end face of the upper thin plate oriented toward the lower thin plate; together with an opposed upper end face of the lower thin plate, oriented toward the upper thin plate, this forms the at least one conduit.

To deliver the gas to the conduits, it is particularly advantageous if recesses begin at the side faces of the upper and/or lower thin plates, extending in the direction of the at least one injection port or through opening and establishing communication between the circumference of the thin plate and the conduits of the perforated body.

However, if it is necessary to deliver a particularly large gas quantity and thus if a large cross-sectional area of the at least one conduit is necessary, then it is advantageous if the lower end face of the upper thin plate, oriented toward the lower thin plate, has at least one upper through groove, and the upper end face of the lower thin plate oriented toward the upper thin plate has at least one lower through groove, so that the at least one conduit is formed by the at least one upper through groove and the at least one lower through groove.

For good atomization of the fuel, it is advantageous if the center line of the conduit is located in the same plane as the center line of the at least one injection port.

To prevent fuel from flowing into the conduits, it is advantageous if the at least one upper through groove in the upper thin plate is embodied such that it does not extend as far as an injection port, and that the conduit discharges into the through opening on an incline relative to the longitudinal axis of the valve.

To deliver the gas to the perforated body, it is advantageous if the injection end of the valve receives the perforated body and is surrounded by a delivery bush, on the circumference of which at least one transverse opening is formed, serving to deliver gas.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
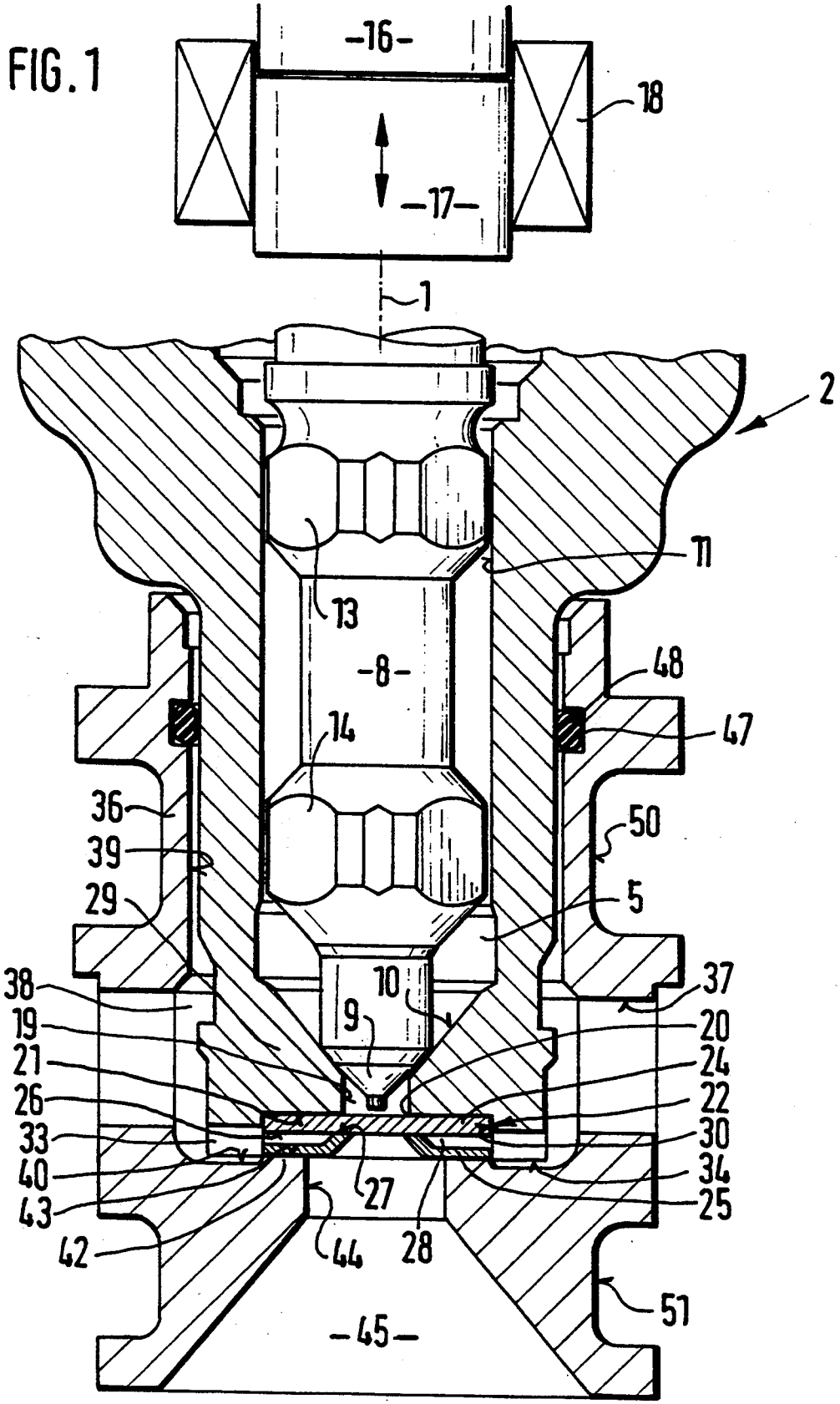
FIG. 1 shows a first exemplary embodiment of an injection valve, embodied in accordance with the invention and shown in fragmentary form.

FIG. 1 is a fragmentary view of a fuel injection valve in a first exemplary embodiment, which can be used for injection systems in mixture-compressing internal combustion engines having externally supplied ignition. A nozzle body 2 of the valve, for instance, embodied of a ferromagnetic material, has a stepped flow conduit 5 concentric with a longitudinal axis 1 of the valve. A valve needle 8 is disposed in the flow conduit 5. With its downstream end, which is for instance embodied as a valve closing element 9 that tapers conically in the downstream direction, the valve needle 8 cooperates with a valve seat face 10, for instance, tapering conically in the flow direction, of the stepped flow conduit 5. A guide portion 11 of the flow conduit 5 formed upstream of the valve seat face 10 serves to guide the valve needle 8 in its axial motion; with its one upper guide collar 13 and its one lower guide collar 14, the valve needle 8 protrudes through the guide portion 11 of the flow conduit 5 with slight radial spacing.

The axial motion of the valve needle 8 and thus the opening and closing of the valve are effected electromagnetically in a known manner, for instance. As suggested in FIG. 1, the valve needle 8 is connected on its end remote from the valve seat face 10 to an armature 17, which cooperates with a magnet coil 18 and an inner pole 16 of the fuel injection valve.

In the direction remote from the magnet coil 18, following the conical valve seat face 10, the flow conduit 5 continues in the form of a cylindrical flow portion 19 and ends in a flow opening 20 of the nozzle body 2. Immediately following the flow opening 20 in the downstream direction, there is a perforated body 22, which comprises an upper thin plate 24, for instance square, oriented toward the valve seat face 10 and a square lower thin plate 25. The upper thin plate 24 rests with its one lower end face 26, remote from the flow opening 20, on an upper end face 27, oriented toward the upper thin plate 24, of the lower thin plate 25 and is joined to it. Both the upper thin plate 24 and the lower thin plate 25 are embodied of monocrystalline silicon, however, it is also possible to select some other suitable material, such as some other monocrystalline semiconductor, like germanium, or a composite semiconductor, like gallium arsenide. The axial thickness of the upper thin plate 24 and lower thin plate 25 is approximately 0.2 to 0.5 mm each, preferably approximately 0.3 mm.

Between the upper thin plate 24 and the lower thin plate 25, at least one conduit 28 is formed, by way of which a gas serving to form a fuel/gas mixture is brought radially from the circumference of the thin plates 24, 25 to flow toward the fuel.

In order to assure that the position of the perforated body 22 with respect to the flow opening 20 of the stepped flow conduit 5 remains the same and to prevent horizontal shifting of the perforated body 22 relative to the flow opening 20, a recess 30 is embodied in an end face 34 of a downstream injection end 29 of the nozzle body 2, in such a form that the recess 30 encircles the perforated body 22, and the flow opening 20 discharges at the bottom 21 of the recess 30 on which the perforated body 22 rests with its upper thin plate 24. At least one delivery groove 33 is formed so that the gas can reach the at least one conduit 28 of the perforated body 22 in the radial direction, between the circumference of the injection end 29 of the nozzle body 2 and the recess 30; beginning at the end face 34 of the injection end 29 toward the valve seat face 10, this groove 33 extends for instance radially at least as far as the at least one conduit 28.

However, it is also possible, for the same purpose, for at least one delivery bore be formed in the injection end 29 of the nozzle body 22, or at least one delivery conduit be formed between the outer rim of the perforated body 22 and the wall of the recess 30.

On its end toward the end face 34, the nozzle body 2 is surrounded, in both the radial and axial directions, for instance, by a delivery bush 36. In the axial direction, in the region of the injection end 29, the delivery bush 36 has transverse openings 37, for instance four in number, which extend inward in the radial direction from the circumference of the delivery bush 36 to an annular delivery chamber 38, which is formed between the circumference of the injection end 29 and a stepped longitudinal opening 39 of the delivery bush 36.

A bottom 40 of the delivery bush 36 oriented toward the injection end 29 of the nozzle body 2 has a bearing shoulder 42 oriented in the radial direction toward the longitudinal axis 1 of the valve. With a bearing face 43 extending at right angles to the longitudinal axis 1 of the valve, the bearing shoulder 42 protrudes axially toward the injection end 29, beyond the bottom 40. The delivery bush 36 rests tightly against the perforated body 22 with its flat bearing face 43 and thus reliably fixes the axial position of the perforated body 22 and the recess 30 of the nozzle body 2 and assures that the gas will flow toward the injected fuel solely via the at least one conduit 28. Immediately following the perforated body 22 in the flow direction, a mixing opening, which for instance is cylindrical in shape and extends concentrically with the longitudinal axis 1 of the valve, extends from the bottom 40 of the delivery bush 36; in the downstream direction, this opening 44 is adjoined by a mixture injection opening 45 that widens in a funnel-like fashion.

A first annular groove 47, which receives a sealing ring 48, is formed in the longitudinal opening 39 of the delivery bush 36, on its end remote from the mixture injection port 45, above the transverse openings 37, which for instance are four in number. The sealing ring 48 forms a seal between the circumference of the nozzle body 2 and the longitudinal opening 39 of the delivery bush 36.

If the valve with its delivery bush 36 is mounted in a valve receptacle, for instance of an engine intake line, then it is necessary for the delivery bush 36 to be sealed off from the wall of the valve receptacle above and below its transverse openings 37. To this end, a second annular groove 50, above the transverse openings 37, oriented toward the magnet coil 18, and a third annular groove 51 below the transverse openings 37 are formed out of the circumference of the delivery bush 36; a sealing ring can be disposed in each of these annular grooves.

Figure 2:
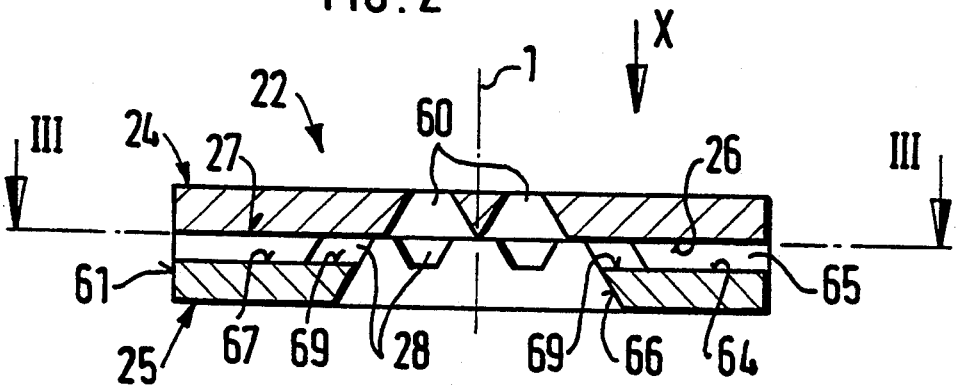
FIG. 2 is a front view of a perforated body according to the first exemplary embodiment.
Figure 3:
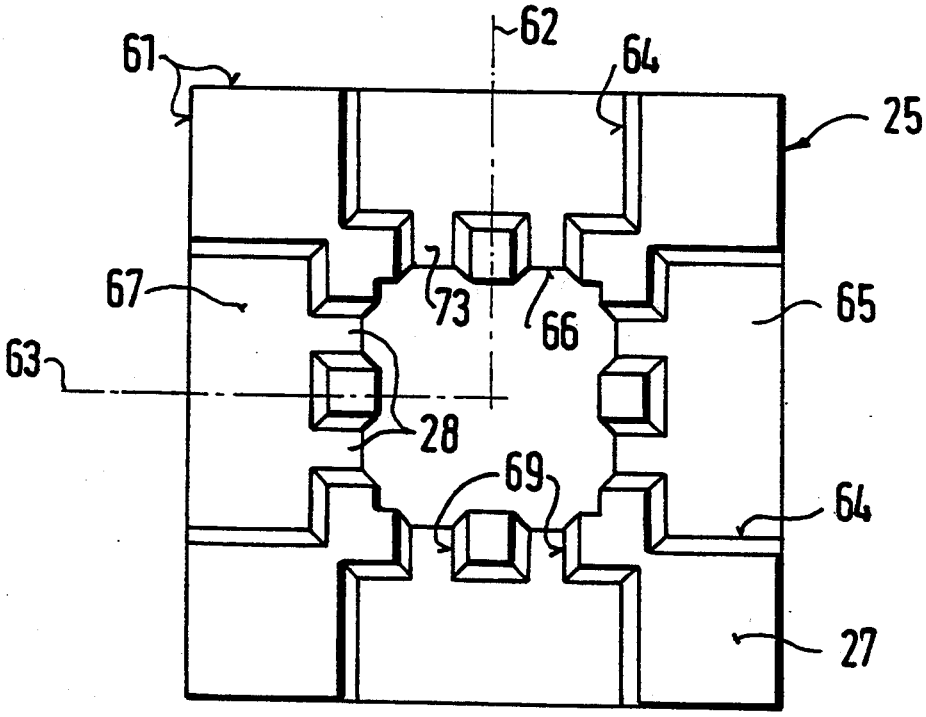
FIG. 3 is a plan view on a lower thin plate, in a section taken along the line III—III of FIG. 2.
Figure 4:
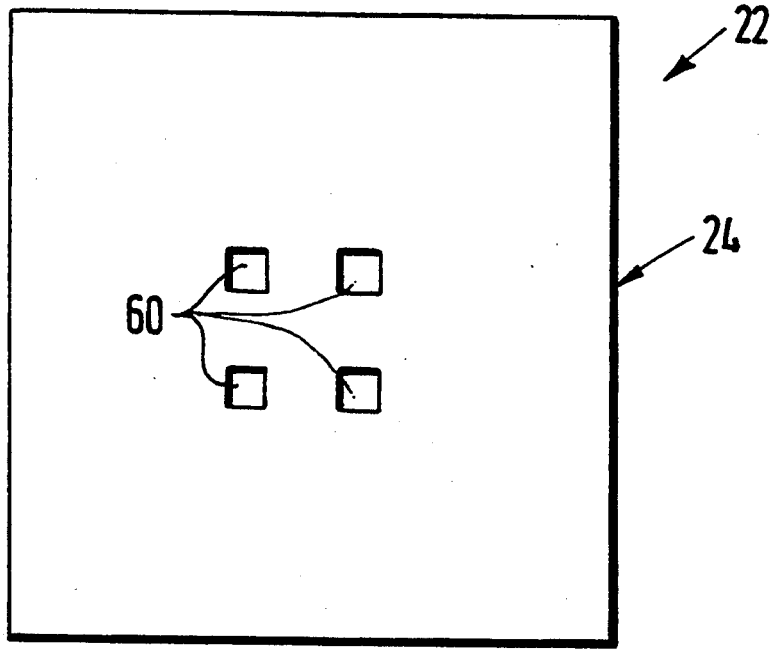
FIG. 4 is a front view of the perforated body of the first exemplary embodiment in the direction of the arrow X in FIG. 2.

FIG. 2 shows a perforated body 22 in according with the first exemplary embodiment shown in FIG. 1. In FIG. 3, a plan view on the lower thin plate 25, in a section taken along the line III—III of FIG. 2, and in FIG. 4 a front view of the perforated body 22 in the direction of the arrow X in FIG. 2 are shown.

As these drawing figures show, the upper thin plate 24, which for instance is square, has injection ports 60 that extend through the upper thin plate, for instance four in number, which are in the shape of truncated pyramids and are located symmetrically with respect to the longitudinal axis 1 of the valve; these ports 60 widen in the direction of the lower face end 26 of the upper thin plate 24, and border one another directly at the lower face end 26. The flow opening 20 of the flow conduit 5 has a cross section that overlaps all the injection ports 60, and this opening 20 communicates in the downstream direction with the injection ports 60. At their narrowest point, the length of a side of the injection openings 60 is approximately 0.1 to 0.25 mm.

The lower thin plate 25, which for instance is also square, has four outer side faces 61, which define the outside of the lower thin plate 25 in the vertical direction extending parallel to the longitudinal axis 1 of the valve and which are at right angles to one another at their ends. For assembling the perforated body 22, comprising the upper thin plate 24 and the lower thin plate 25, it is especially practical, as also shown in the drawing in accordance with the exemplary embodiments, that the upper thin plate 24 and the lower thin plate 25 have identical dimensions in terms of their circumference. The perforated body 22 has a first axis of symmetry 62 and a second axis of symmetry 63, which divide the outer side faces 61 in half. One recess 64 each, having a rectangular bottom 67, is formed out of the upper face end 27 of the lower thin plate 25, centrally symmetrically to the respective axis of symmetry 62 or 63, beginning from each outer side face 61 and being narrower than that face. The recesses 64 widen in the direction from the bottom 67 to the upper face end 27 of the lower thin plate 25 in trapezoidal fashion and together with the lower face end 26 of the upper thin plate 24 they each form one inflow chamber 65. Concentrically with the longitudinal axis 1 of the valve, the lower thin plate 25 has a through opening 66, for instance square in shape, which widens in the form of a truncated pyramid in the flow direction. The recesses 64, or in other words the inflow chambers 65, extend inward in the direction of the through opening 66, but do not communicate directly with the through opening 66.

There is at least one lower through groove 69 leading inward, and in the first exemplary embodiment there are two of them, for example, between each recess 64 and the through opening 66 in the upper face end 27 of the lower thin plate 25, in the direction of the applicable axis of symmetry 62 or 63; together with the lower end face 26 of the upper thin plate 24, these grooves each form one conduit 28. The conduits 28 furnish communication between the inflow chambers 65, which are open toward the circumference of the thin plates 24, 25, and the through opening 66 of the perforated body 22, and they extend parallel to the respective axes of symmetry 62 and 63. The two conduits 28, located side by side and beginning in the same inflow chamber 65, have the same spacing from the respective axis of symmetry 62 or 63, resulting in an axially symmetrical and point-symmetrical embodiment of the perforated body 22. The lower through grooves 69 have a rectangular bottom 73, and they widen trapezoidally up to the upper face end 27 of the lower thin plate 25. The axial length of the lower through grooves 69 in the direction of the axes of symmetry 62, 63 is approximately 0.1 to 0.25 mm. The conduits 28 are preferably aligned such that the emerging gas strikes the fuel emerging from one of the injection ports 60. The center lines of the conduits 28 are preferably located in a plane that extends through at least one of the center lines of the injection ports 60. Transversely to their center lines, the conduits 28 are always so narrow that they extend over only portions of the circumference of the through opening 66 or of one of the injection ports 60 such that they overlap.

The embodiment of the injection ports 60, recesses 64, through opening 66 and lower through grooves 69 in the upper thin plate 24 and lower thin plate 25, which are of monocrystalline silicon, are formed in a known manner, for instance by anisotropic etching. First, the planes of a thin plate of silicon are polished and coated with a thin oxide film, and a photoresist layer is applied to the planes. A photomask is placed on the photoresist and then exposed to light. Using a developer fluid produces a pattern of some areas covered with the photoresist and other areas of plain oxide on the chip. In a bath with hydrofluoric acid, the oxide areas that have been laid bare are etched away, and the photoresist is then removed. The result is a pattern of oxide on the plate that serves as a mask for the ensuing etching. Lyes or acids attack the bore silicon and create indentations in the monocrystalline thin plates. If anisotropic etching media are used, the indentations grow downward only and do not widen horizontally. The side walls of the indentations are formed by the crystal planes of the silicon plate, resulting in a trapezoidal cross section of the indentations. The etching process stops as soon as a layer, doped for instance with boron, is reached in the direction in which etching proceeds.

Other cross sections, for instance rectangular cross sections, are also possible for the injection ports 60, recesses 64, through openings 66 and lower through grooves 69, besides the trapezoidal or truncated cone cross sections formed by anisotropic etching and shown in the first exemplary embodiment.

The lower face end 26 of the upper thin plate 24 and the upper face end 27 of the lower thin plate 25 are joined together by bonding. To this end, the lower end face 26 of the upper thin plate 24 and the upper end face 27 of the lower thin plate 25 are first polished, and the surfaces are treated chemically.

Next, the prepared surfaces of the upper thin plate 24 and lower thin plate 25 are joined together at room temperature. The bonding process is for instance ended by a temperature treatment of the upper thin plate 24 and lower thin plate 25 in a nitrogen atmosphere.

Through the transverse openings 37, the gas serving to form the fuel/gas mixture reaches the delivery chamber 38 formed between the circumference of the nozzle body 2 and the longitudinal opening 39 of the delivery bush 36. From there, the gas flows through the inflow chambers 65, which for instance are four in number, and through the two conduits 28 each communicating with inflow chambers, to the through opening 66 of the perforated body 22, which extends concentrically with the longitudinal axis of the valve 1 and in which the fuel is also injected through the injection ports 60.

The conduits 28 have a narrow cross section, which throttles the flowing gas and thus serves to meter the gas. The narrow cross section also serves to accelerate the gas, so that the gas meets the injected fuel at high speed and envelops it. The result is a fuel/gas mixture as homogeneous as possible. The fuel/gas mixture is fed into the intake line of the engine, for instance, through the mixture injection port 45.

The gas is for instance air diverted into the intake tube of the engine by a bypass upstream of a throttle valve. However, it is also possible to use recirculated engine exhaust gas in order to reduce toxic emissions, or to use some other gas (air, exhaust gas) furnished through an additional blower.

Figure 5:
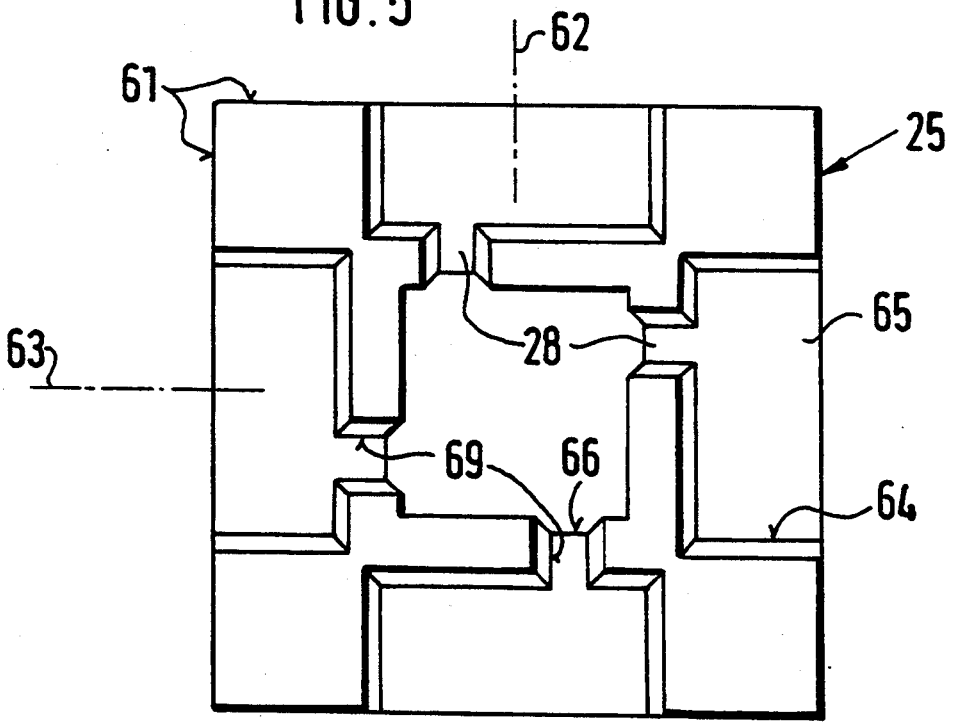
FIG. 5 is a plan view of a second exemplary embodiment of a lower thin plate in a section through a perforated body corresponding to FIG. 3.

A lower thin plate 25 of a perforated body 22 according to a second exemplary embodiment of the invention is shown in FIG. 5. Elements that are the same and function the same are provided with the same reference numerals as in FIGS. 1–4.

The second exemplary embodiment differs from the first solely in the number of conduits 28 and the number of lower through grooves 69 formed out of the upper face end 27 of the lower thin plate 25. Beginning at the four recesses 64 of the upper face end 27, one lower through groove 69 each, leading inward, is formed; by way of example, it extends parallel to the respective axis of symmetry 62 or 63 of the lower thin plate 25 and discharges into the through opening 66. Beginning at the respective inflow chamber 65 in the flow direction toward the through bore 66 of the lower thin plate 25, the lower through grooves 69 are for instance all formed on the right-hand side of the applicable axis of symmetry 62 or 63. As a result, the gas is delivered into the through opening 66 with a spin. This improves the mixing of fuel and gas.

Figure 6:
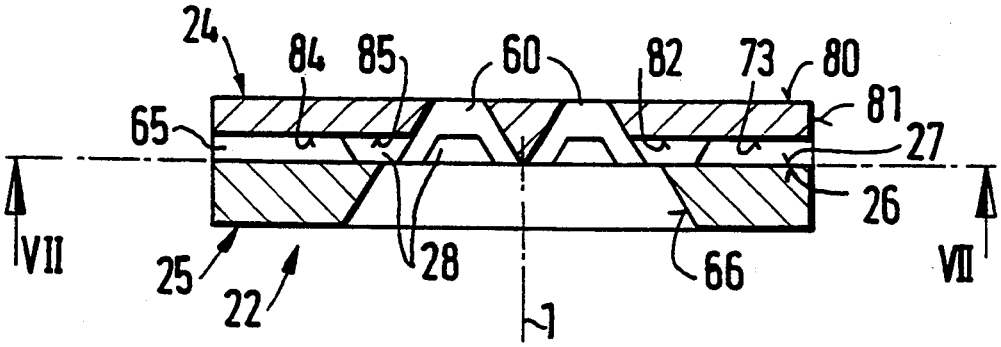
FIG. 6 is a front view of a perforated body in a third exemplary embodiment.
Figure 7:
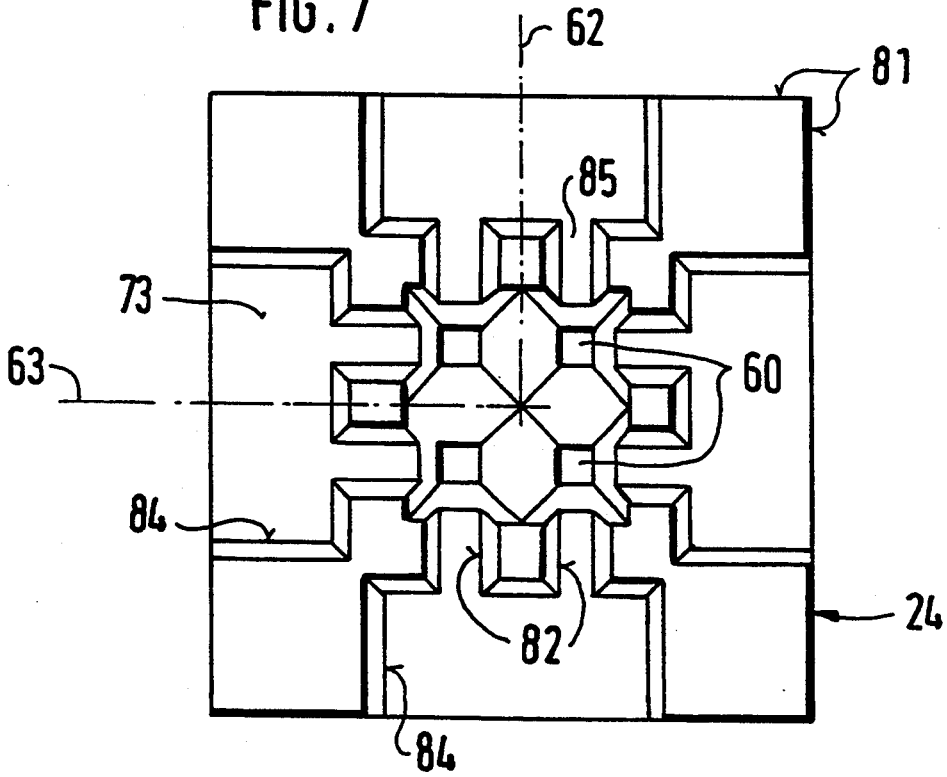
FIG. 7 is a front view of an upper thin plate in a section taken along the line VII—VII of FIG. 6.

In FIG. 6 and in FIG. 7, which is a front view of the upper thin plate 24 in a section taken along the line VII—VII of FIG. 6, a perforated body 22 according to a third exemplary embodiment of the invention is shown; parts that are the same and function the same are identified by the same reference numerals as in FIGS. 1–5. As in the first two exemplary embodiments, the upper square thin plate 24 and the lower square thin plate 25 of the third exemplary embodiment are of monocrystalline silicon and are joined together by bonding. The injection ports 60, recesses 84, through opening 66 and upper through grooves 82 are formed by anisotropic etching, for instance.

The square through opening 66 that widens in the form of a truncated pyramid in the flow direction beginning at the upper face end 27 of the lower thin plate 25 is formed in the lower thin plate concentrically with the longitudinal axis 1 of the valve. Communicating with the through opening 66 are square injection ports 60, for instance four in number, which are formed in the upper thin plate 24 symmetrically with the longitudinal axis 1 of the valve. Beginning at an upper face end 80 of the upper thin plate 24 and extending toward its lower face end 26, the injection ports 60 expand in the manner of a truncated pyramid and border one another directly at the lower face end 26 of the upper thin plate 24.

The upper thin plate 24 is defined on the outside by four side faces 81 which are at right angles to one another at their ends. Beginning at each of the side faces 81, a respective recess 84 is formed in the lower face end 26 of the upper thin plate 24, extending inward in the direction of the injection ports 60 and having a rectangular bottom 73; the recesses 64 are symmetrical with the axes of symmetry 62 and 63 and are divided into two parts of equal size by one of these axes. The recesses 84 taper trapezoidally toward the upper face end 80 of the upper thin plate 24. Together with the upper face end 27 of the lower thin plate 25, the recesses 84 each form one inflow chamber 65. Each inflow chamber 65 communicates, for instance by means of two conduits 28 each, with the downstream ends of the injection ports 60. The conduits 28 are formed by upper through grooves 82, extending in the lower face end 26 of the upper thin plate 24 and having a rectangular bottom 85 toward the upper face end 80, and by the upper face end 27 of the lower thin plate 25, and transversely to their center lines they are always so narrow that they extend over only portions of the periphery of the through opening 66 or of one of the injection ports 60. The upper through grooves 82 have a trapezoidal cross section and narrow in the direction of the upper face end 80 of the upper thin plate 24. The axial length of the upper through grooves 82 is approximately 0.1 to 0.25 mm.

To attain a particularly homogeneous fuel/gas mixture, two conduits 28 each, each beginning at one inflow chamber 65, extend symmetrically, spaced apart by an equal distance, and parallel to the respective axes of symmetry 62 and 63. Each conduit 28 discharges directly into an injection port 60, and the delivered gas meets the centrally injected fuel there.

Figure 8:
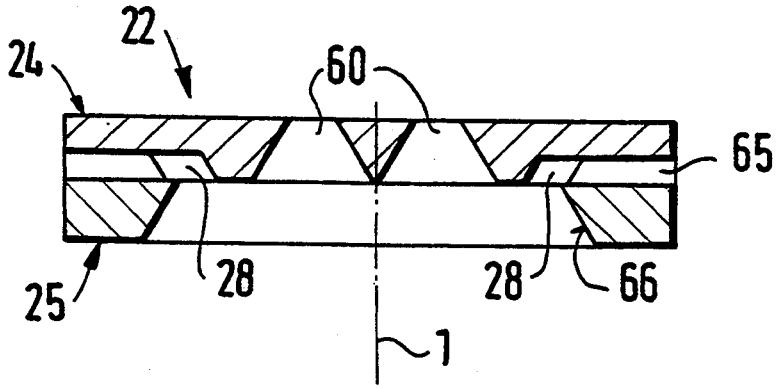
FIG. 8 is a view of a perforated body in a fourth exemplary embodiment.

A perforated body 22 in a fourth exemplary embodiment of the invention is shown in FIG. 8. Identical parts that function the same are provided with the same reference numerals as in FIGS. 1–7. Unlike the third exemplary embodiment, the conduits 28 extending in the upper thin plate 24 do not discharge directly into the injection ports 60 of the upper thin plate 24 but rather, inclined obliquely downward with respect to the longitudinal axis 1 of the valve, into the through opening 66 of the lower thin plate 25, so that the gas reaches the through opening 66 directly through the inflow chambers 65 and the conduits 28, and in contrast to the first three exemplary embodiments meets the injected fuel not at right angles, but rather obliquely in the direction of fuel flow. Furthermore, an inflow of fuel into the conduits 28 is prevented. Otherwise, the fourth exemplary embodiment is substantially equivalent to the third exemplary embodiment.

Figure 9:
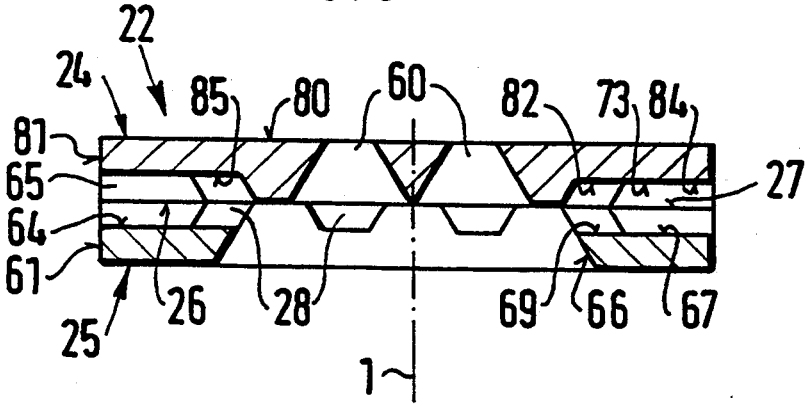
FIG. 9 is a view of a perforated body in a fifth exemplary embodiment.

A perforated body 22 of a further, fifth exemplary embodiment of the invention is shown in FIG. 9. Identical parts that function the same are provided with the same reference numerals as in FIGS. 1–8.

Square injection openings 60, for instance four in number, are formed in the upper thin plate 24 symmetrically with the longitudinal axis 1 of the valve. Beginning at the upper face end 80 and extending in the direction of the lower face end 26 of the upper thin plate 24, the square injection ports 60 widen in the manner of a truncated pyramid and border one another directly at the lower face end 26. Concentrically with the longitudinal axis 1 of the valve, the lower thin plate 25 has the through opening 66, which widens in the manner of a truncated pyramid in the flow direction and has a square cross section.

Beginning at each of the four side faces 61 of the lower thin plate 25, one recess 64 each, having a rectangular bottom 67, is formed in the upper face end 27 of the lower thin plate 25, extending in the direction of the through opening 66 of the lower thin plate 25. As shown for the first exemplary embodiment, the recesses 64 are symmetrical with the axes of symmetry 62 and 63, which represent the center lines of the recesses 64. The recesses 64 taper trapezoidally in the direction remote from the upper thin plate 24.

Two lower through grooves 69, for instance, are formed in the upper face end 27 of the lower thin plate 25 beginning at each of the four recesses 64; the through grooves extend as far as the through opening 66 and discharge into it. Their embodiment is for instance equivalent to that of the lower through grooves 69 in the first exemplary embodiment according to the invention.

Beginning at each of the four side faces 81 of the upper thin plate 24, one recess 84 each is formed, having a rectangular bottom 73, in the opposed lower face end 26 of the upper thin plate 24. The recesses 84 extend inward toward the injection ports 60, terminate upstream of them, and as for instance shown in the third exemplary embodiment are symmetrical with the axes of symmetry 62 and 63, which represent the center axes of the recesses 64. The trapezoidal recesses 84 taper in the direction of the upper face end 80 of the upper thin plate 24.

The recesses 64 in the recesses 84, which overlap at the upper face end 27 of the lower thin plate 25 and at the lower face end 26 of the upper thin plate 24 and together form the respective inflow chambers 65, have identical geometrical dimensions and an identical location with respect to the axes of symmetry 62 and 63, by way of example, at least in the region where they overlap.

Of each of the four recesses 84 formed in the lower face end 26 of the upper thin plate 24, two upper through grooves 82 extend inward in the direction of the injection ports 60. The upper through grooves 82 extend parallel to the respective axis of symmetry 62 or 63, and toward the upper face end 80 they have a trapezoidally narrowing cross section and a rectangular bottom 85. The various upper through grooves 82 and lower through grooves 69 overlap at the lower face end 26 of the upper thin plate 24 and at the upper face end 27 of the lower thin plate 25 such that together, one upper through groove 82 and one lower through groove 69 each forms one conduit 28, which does not extend as far as an injection port 60 but rather, inclined downward relative to the longitudinal axis 1 of the valve, discharges into the through opening 66 of the lower thin plate 25 and is aimed at one of the fuel streams emerging from the injection ports 60. At least in the region of their overlap, the respective upper through grooves 82 and the lower through grooves 69 have identical geometrical dimensions and an identical location with respect to the axis of symmetry 62 or 63.

Figure 10:
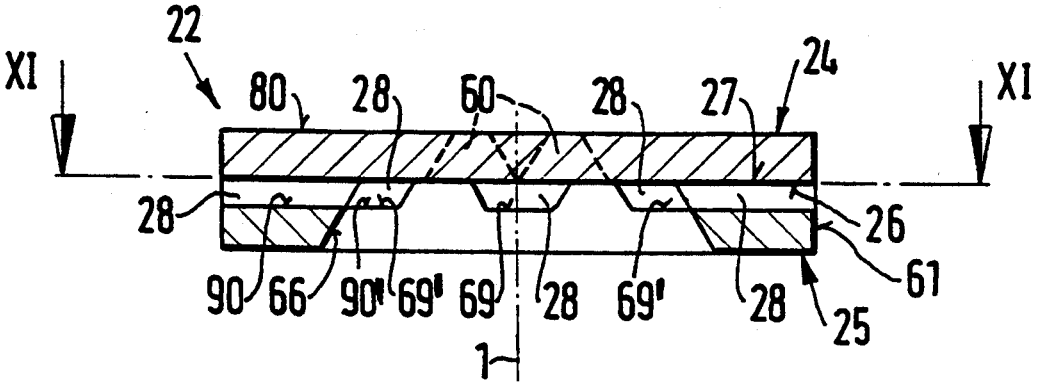
FIG. 10 is a view of a perforated body in a sixth exemplary embodiment.
Figure 11:
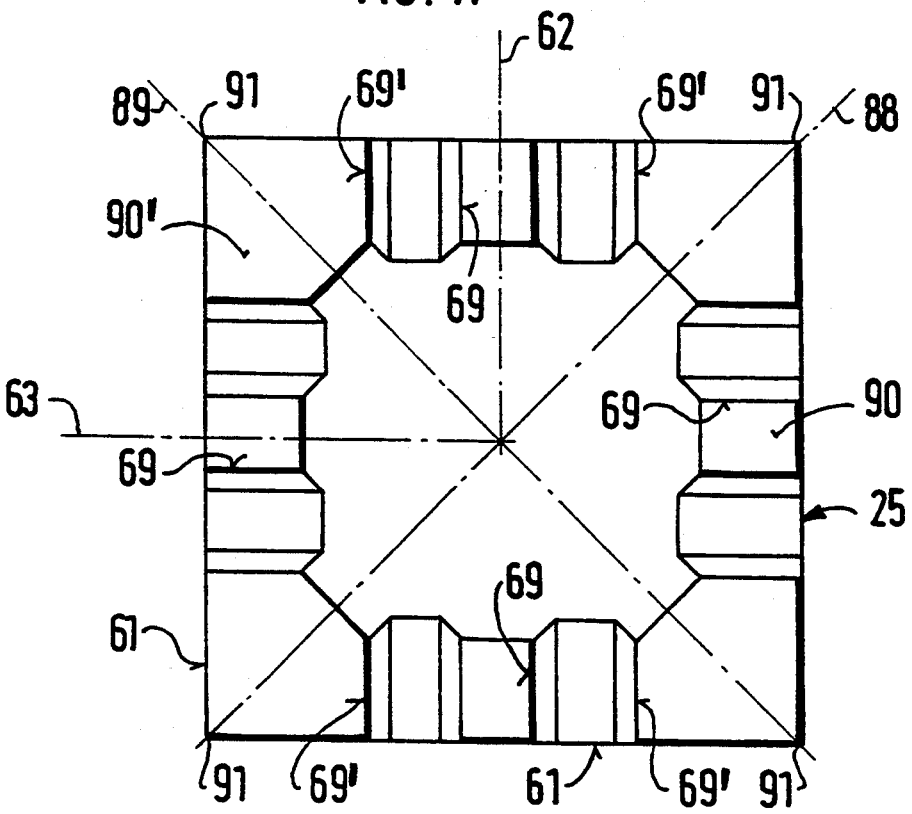
FIG. 11 is a plan view on a lower thin plate in a section taken along the line XI—XI of FIG. 10.

FIGS. 10 and 11 show a perforated body 22 according to a sixth exemplary embodiment of the invention; FIG. 11 is a plan view in the direction of the lower thin plate 25 corresponding to a section taken along the lines XI—XI of FIG. 10. Identical parts that function the same are identical by the same reference numerals as in FIGS. 1–9. The perforated body 22 comprises the upper square thin plate 24 and the lower square thin plate 25, both of them embodied of monocrystalline silicon and joined together by bonding. The upper square thin plate 24 and the lower square thin plate 25 have identical external dimensions. As suggested in dashed lines in FIG. 10, square injection ports 60, for instance four in number, are formed in the upper plate 24, extending symmetrically to the longitudinal axis 1 of the valve, and beginning at the upper face end 80 and extending toward the lower face end 26 of the upper thin plate 24 they widen in the manner of a truncated pyramid, bordering one another directly at the lower face end 26. The lower thin plate 25 has a through opening 66 extending concentrically with the longitudinal axis 1 of the valve; this opening has a square cross section, for instance, and widens trapezoidally in the direction remote from the upper thin plate 24.

Besides the axes of symmetry 62 and 63 extending parallel to the side faces 61, first and second diagonals 88 and 89, respectively, of the lower thin plate 25 are also shown. Beginning at each outer side face 61 of the lower thin plate 25, lower through grooves 69 parallel to the two axes of symmetry 62 and 63 are formed, and symmetrically with the two diagonals 88 and 89, beginning at the corners 91, two lower through grooves 69' facing one another are each formed in the upper face end 27 of the lower thin plate 25, these grooves extending inward as far as the through opening 66. The axes of symmetry 62 and 63 and the diagonals 88 and 89 form the center axes of the lower through grooves 69 and 69'. While the lower through grooves 69 extending parallel to the axes of symmetry 62 and 63 have a rectangular bottom 90, the lower through grooves 69' that extend symmetrically with the diagonals 88 and 89 have a bottom 90' that tapers in the direction of the through opening 66. In the direction remote from the upper face end 27, the lower through grooves 69 and 69' taper trapezoidally. Along with the lower face end 26 of the upper thin plate 24, the lower through grooves 69 and 69' form the conduits 28 that discharge into the through opening 66.

Particularly uniform envelopment and preparation of the fuel injected from the injection ports 60 are made possible in this exemplary embodiment, by means of the gas delivered through the conduits 28.

Figure 12:
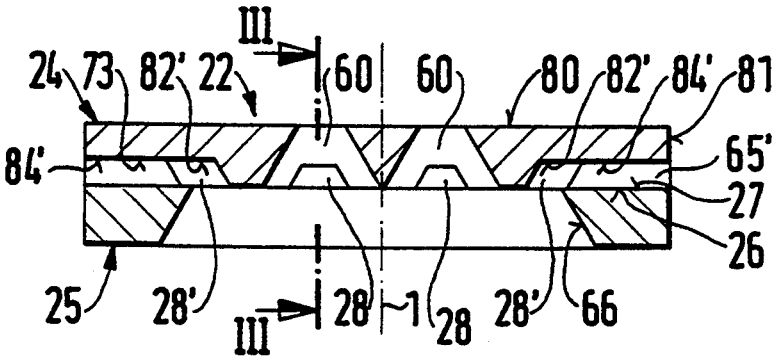
FIG. 12 is a section through a perforated body in a seventh exemplary embodiment taken along the line XII—XII of FIG. 14.
Figure 13:
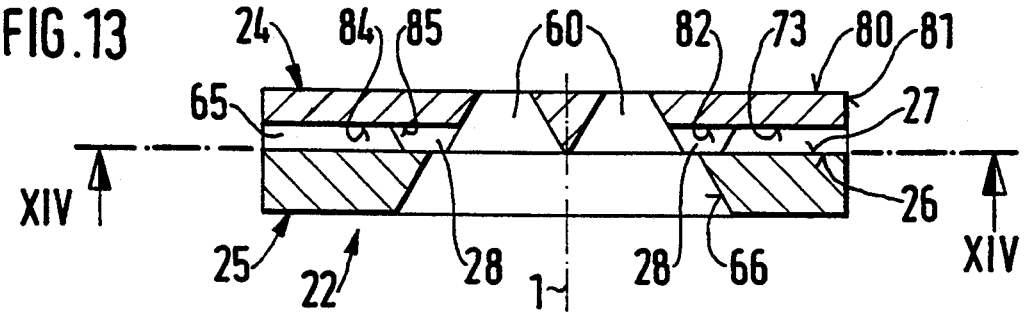
FIG. 13 is a section taken along the line XIII—XIII in FIG. 12.
Figure 14:
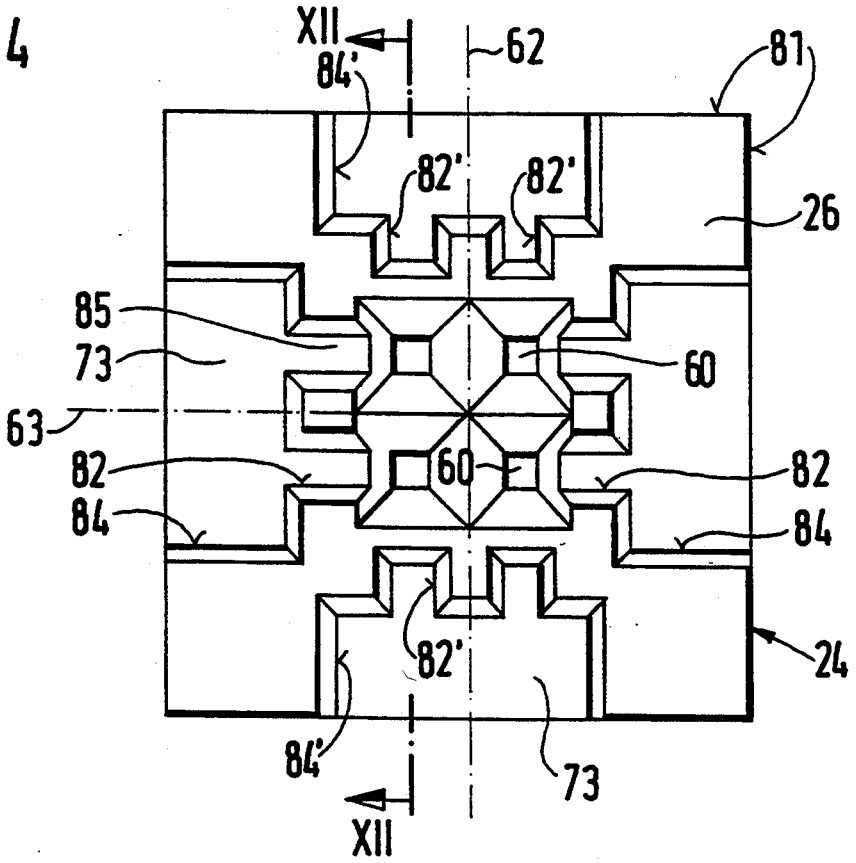
FIG. 14 is a front view of an upper thin plate in a section taken along the line XIV—XIV of FIG. 13.

FIGS. 12–14 show a perforated body 22 in a seventh exemplary embodiment of the invention; parts that are the same and function the same are again identified by the same reference numerals as in FIGS. 1—11. FIG. 13 is a section taken along the line XIII—XIII of FIG. 12, and FIG. 14 is a front view of the upper thin plate 24 in a section taken along the line XIV—XIV of FIG. 13. The upper square thin plates 24 and the lower square thin plates 25 are made of monocrystalline silicon and are joined together, for instance by bonding. The injection ports 60, recesses 84, through opening 66 and the upper through grooves 82, 82' are formed for instance by anisotropic etching.

The rectangular through opening 66, which widens in the form of a truncated pyramid in the flow direction beginning at an upper face end 27 of the lower thin plate 25, is formed in the lower thin plate 25 concentrically with the longitudinal axis 1 of the valve. Communicating with the through opening 66 are injection ports 60, for instance four in number, which are formed in the upper thin plate 24 symmetrically with the longitudinal axis 1 of the valve. Beginning at an upper face end 80 of the upper thin plate 24, the injection ports 60 widen in the direction of its lower face end 26 in the manner of a truncated pyramid, and for instance at the upper face end 26 of the upper thin plate 24, they border one another directly.

Beginning at each of the four side faces 81 of the upper thin plate 24, which are at right angles to one another, one recess 84, 84' each is formed in the lower face end 26 of the upper thin plate 24, having a bottom 73 that is for instance rectangular, and extending inward in the direction of the injection ports 60. The recesses 84 are for instance symmetrical with the axis of symmetry 63, and the recesses 84' are for instance symmetrical with the axis of symmetry 62; they are divided into two equal parts by their respective axes of symmetry 63 and 62, and they taper in the direction of the upper face end 80 of the upper thin plate 24. Together with the upper face end 27 of the lower thin plate 25, the recesses 84 and 84' each form one inflow chamber 65 and 65'.

Two inflow chambers 65 facing one another, which are divided by the axis of symmetry 63, for instance, into two equal parts, each communicate through two conduits 28 with the downstream ends of the injection ports 60. The conduits 28 are formed by upper through grooves 82 extending in the lower face end 26 of the upper thin plate 24 and by the upper face end 27 of the lower thin plate 25, and transversely to their center lines, for instance, are so narrow that they extend over only portions of the injection ports 60. The upper through grooves 82 taper in the direction of the upper face end 80 of the upper thin plate 24.

The two other inflow chambers 65' facing one another and disposed at an angle to the first, which are divided into two equal parts, for instance by the axis of symmetry 62, communicate with the through opening 66 of the lower thin plate 25 through two conduits 28' each, which do not extend as far as an injection port 60 but instead are inclined obliquely downward relative to the longitudinal axis 1 of the valve. The conduits 28' are formed by the upper through grooves 82' extending in the upper thin plate 24. Thus the gas, through the inflow chambers 65' and the conduits 28', directly reaches the through opening 66 and in the direction of fuel flow meets the injected fuel obliquely.

In this way, a particularly homogeneous fuel/gas mixture can be attained, in which first some of the gas directly meets the fuel flowing through the injection port 60, and the remainder of the gas is delivered, inclined obliquely in the region of the through opening 66, to the mixed flow of fuel and gas.

The exemplary embodiments according to the invention make it possible to meter the gas in minimum space, without the conduits 28, 28', which transversely to their center lines are always so narrow that they extend over only portions of the periphery of the through opening 66 or of one of the injection ports 60, have to be adjusted in the ready-mounted valve to attain the desired metered gas quantity. Very accurate manufacture of the upper thin plate 24 and lower thin plate 25 is therefore required. To this end, it is particularly advantageous to embody the upper thin plate 24 and lower thin plate 25 of monocrystalline silicon, and to form the injection port 60, recesses 64 and 84, 84', the through opening 66, the lower through grooves 69, 69' and the upper through grooves 82, 82' by anisotropic etching, for example.

The perforated body can be used not only in fuel injection valves for fuel injection systems, but also to atomize other media, or in other words whenever superfine fluid droplets are required, for example for uniform spray application of paints and lacquers, and in manufacturing processes or the like.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A perforated body having a monocrystalline silicon upper plate (24) with at least one injection port (60) extending axially through the upper plate (24) and a monocrystalline silicon lower plate (25) with at least one through opening (66) extending axially through the lower plate (25) and joined together by bonding, at least one conduit (28, 28') formed between the upper and lower plates of said perforated body, said at least one through opening (66) extending axially through the lower plate (25) overlaps said at least one injection port (60) extending axially through the upper plate (24), and the at least one conduit (28, 28') communicates with a perimeter of each of the upper and lower plates (24, 25), and communicates with the at least one through opening (66) extending axially through the lower plate (25).

2. A perforated body as defined by claim 1, wherein said at least one injection port (60) extends axially through the upper plate (24), said at least one through opening (66) extends axially through the lower plate (25), through grooves (69, 69', 82, 82') and recesses (64, 84, 84') of the upper plate (24) and lower plate (25) are formed by anisotropic etching.

3. A perforated body as defined by claim 2, in which the at least one upper through groove (82, 82') of the upper plate (24), is embodied such that it does not extend as far as an injection port (60), and that the conduit (28, 28') discharges into the through opening (66) on an incline with respect to the longitudinal axis (1) of the valve.

4. A valve, in particular a fuel injection valve for supplying an internal combustion engine with a fuel/gas mixture, having a valve closing element that cooperates with a valve seat face, and a perforated body disposed downstream of the valve seat face, said perforated body (21) comprises an upper plate (24), oriented toward the valve seat face (10) and having at least one injection port (60) extending axially through the upper plate (24), and a lower plate (25), in contact with the upper plate (24) and having at least one through opening (66) extending axially through the lower plate (25), and that the upper plate (24) and the lower plate (25) define at least one conduit (28, 28'), via which the gas is delivered and which is aimed at the fuel output through the at least one injection port (60) extending axially through the upper plate (24), and said at least one through opening (66) extending axially through the lower plate (25) overlaps said at least one injection port (60) extending axially through the upper plate (24) and the at least one conduit (28, 28') communicates with a perimeter of each of the upper and lower plates (24, 25) and communicates with the at least one through opening (66) extending through the lower plate (25).

5. A valve as defined by claim 4, in which the upper plate (24) and the lower plate (25) are embodied as monocrystalline silicon.

6. A valve as defined by claim 5, in which said at least one injection port (60) extends axially through the upper plate, said at least one through opening (66), through grooves (69, 69', 82, 82') and recesses (64, 84, 84') of the upper plate (24) and lower plate (25) are formed by anisotropic etching.

7. A valve as defined by claim 5, in which the upper plate (24) and the lower plate (25) are joined together by bonding.

8. A valve as defined by claim 6, in which the upper plate (24) and the lower plate (25) are joined together by bonding.

9. A valve as defined by claim 6, in which the at least one upper through groove (82, 82') of the upper plate (24) is embodied such that it does not extend as far as an injection port (60), and that the conduit (28, 28') discharges into the through opening (66) on an incline with respect to the longitudinal axis (1) of the valve.

10. A valve as defined by claim 4, in which at least one lower through groove (69, 69') is formed in an upper face (27) of the lower plate (25) oriented toward the upper plate (24), said at least one lower through groove, together with an opposed lower face (26) of the upper plate (24), oriented toward the lower plate (25), forms the at least one conduit (28).

11. A valve as defined by claim 4, in which at least one upper through groove (82, 82') is formed in a lower face (26) of the upper plate (24) oriented toward the lower plate (25); said at least one upper through groove, together with an opposed upper end face (27) of the lower plate (25), oriented toward the upper plate (24), forms the at least one conduit (28, 28').

12. A valve as defined by claim 11, in which first upper through grooves (82), facing one another, of the upper plate (24) are embodied such that the first upper through grooves each form one conduit (28) aimed at one injection port (60) of the upper plate (24), and at an angle thereto, second upper through grooves (82'), facing one another, of the upper plate (24) are embodied such that the second upper through grooves (82') do not extend as far as an injection port (60), and each of said second upper through grooves (82') forms one conduit (28') that discharges into the through opening (66) on an incline with respect to the longitudinal axis (1) of the valve.

13. A valve as defined by claim 4, in which the lower face (26) of the upper plate (24) has at least one upper through groove (82, 82'), and the upper face (27) of the lower plate (25) has at least one lower through groove (69), so that the at least one conduit (28, 28') is formed by an overlap of the at least one upper through groove (82, 82') and the at least one lower through groove (69).

14. A valve as defined by claim 4, in which said perforated body includes recesses (64, 84, 84'), which begin at peripheral faces (61, 81) of the lower plate (25) and upper plate (24) to establish a communication between the perimeter of the plates (24, 25), and the conduits (28, 28').

15. A valve as defined by claim 4, in which the at least one injection port (60) in the upper plate (24) and the at least one through opening (66) in the lower plate (25) overlap one another.

16. A valve as defined by claim 4, in which a center line of the conduit (28, 28') is located in the same plane as the center line of the at least one injection port (60).

17. A valve as defined by claim 16, in which two conduits (28) extending at right angles to one another are aimed at one injection port (60).

18. A valve as defined by claim 4, in which the lower plate (25) is embodied as square, and one conduit (28, 28') extends from each side face (61) and from each corner (91) to the through opening (66).

19. A valve having an injection end as defined by claim 4, in which the injection end (29) of the valve receives the perforated body (22) and is surrounded by a delivery bush (36), on the perimeter of which at least one transverse opening (37), serving to deliver gas, is embodied.

20. A valve as set forth in claim 4 in which said at least one injection port (60) extending axially through said upper plate (24) is in axial alignment with said at least one through opening (66) that extends axially through the lower plate 25.

21. A fuel injection valve for supplying an internal combustion engine with a fuel/gas mixture, having a valve closing element that cooperates with a valve seat face along a longitudinal axis, and a perforated body disposed downstream of the valve seat face, said perforated body (21) comprises an upper plate (24), oriented toward the valve seat face (10), said upper plate includes four injection ports (60) extending through the upper plate (24) said four injection ports (60) border one another and are symmetrical with said longitudinal axis, and a lower plate (25), in contact with the upper plate (24) and having at least one through opening (66) extending through the lower plate (25), and that the upper plate (24), and the lower plate (25) define four conduits (28, 28') in which two conduits extend at right angles to one another in which the gas is delivered and each of said four conduits are aimed a different one of said four injection ports (60) extending through the upper plate (24) through which the fuel flows and a center line of the conduits is located in the same plane as a center line of the four injection ports.

22. A perforated body having an upper plate (24) with at least one injection port (60) extending axially through the upper plate (24) and a lower plate (25) with at least one through opening (66) extending axially through the lower plate (25), at least one conduit (28, 28') formed between the upper and lower plates of said perforated body, said at least one through opening (66) extending axially through the lower plate (25) overlaps said at least one injection port (60) extending axially through the upper plate (24), and the at least one conduit (28, 28') has a center line which is located in a same plane as a center line of the at least one injection port 60 and communicates with a perimeter of each of the upper and lower plates (24, 25), and communicates with the at least one through opening (66) extending axially through the lower plate (25).

23. A perforated body as defined by claim 22, in which two conduits (28) extending at right angles to one another are aimed at one injection port (60).

24. A perforated body as defined by claim 22, in which four injection ports (60) bordering one another are embodied in the upper plate (24), symmetrically with the longitudinal axis (1) of the valve, and one conduit (28) is aimed at each injection port (60).

25. A perforated body having an upper plate (24) with at least one injection port (60) extending axially through the upper plate (24) and a lower plate (25) with at least one through opening (66) extending axially through the lower plate (25), at least one conduit (28, 28') formed between the upper and lower plates of said perforated body, said at least one through opening (66) extending axially through the lower plate (25) overlaps said at least one injection port (60) extending axially through the upper plate (24), and the at least one conduit (28, 28') communicates with a perimeter of each of the upper and lower plates (24, 25), and communicates with the at least one through opening (66) extending axially through the lower plate (25), at least one upper through groove (82, 82') is formed in a lower face (26) of the upper plate (24) oriented toward the lower plate (25); which together with an opposed upper face (27) of the lower plate (25), oriented toward the upper plate (24), forms the at least one conduit (28, 28'), said upper through grooves (82) of the upper plate (24) are embodied such that they each form one conduit (28) aimed at one injection port (60) extending through the upper plate (24), and at an angle to said first upper through grooves (82), second upper through grooves (82'), facing one another, of the upper plate (24) are embodied such that said second upper through grooves (82') do not extend as far as an injection port (60), extending through the upper plate (24) and each second upper through groove (82') forms one conduit (28') that discharges into the through opening (66) extending through the lower plate (25) on an incline with respect to the longitudinal axis (1) of the valve.

26. A perforated body having an upper plate (24) with at least one injection port (60) extending axially through the upper plate (24) and a square lower plate (25) with side faces (61) and corners (91), at least one through opening (66) extending axially through the lower plate (25), at least one conduit (28, 28') formed between the upper and lower plates of said perforated body, said at least one through opening (66) extending axially through the lower plate (25) overlaps said at least one injection port (60) extending axially through the upper plate (24), and the at least one conduit (28, 28') extends from each side face (61) and from each corner (91) to the through opening (66) extending axially through the lower plate (25).

* * * * *